US005390431A

United States Patent [19]

Friel

[11] Patent Number: 5,390,431

[45] Date of Patent: Feb. 21, 1995

[54] METHOD AND APPARATUS FOR KNIFE AND BLADE SHARPENING

[75] Inventor: Daniel D. Friel, Greenville, Del.

[73] Assignee: Edgecraft Corporation, Avondale, Pa.

[21] Appl. No.: 55,856

[22] Filed: Apr. 30, 1993

Related U.S. Application Data

[63] Continuation-in-part of Ser. No. 901,213, Jun. 18, 1992, abandoned.

[51] Int. Cl.[6] ..... B24B 1/00

[52] U.S. Cl. ..... 451/45; 451/57; 451/549

[58] Field of Search ..... 51/57, 58, 63, 205 R, 51/205 WG, 211 R, 214, 285, 281 R, 326, 327

[56] References Cited

U.S. PATENT DOCUMENTS

| | | | |
|---|---|---|---|
| 1,570,083 | 1/1926 | Runzi | 51/211 R |
| 2,092,443 | 9/1937 | Crossley | 51/205 WG |
| 2,767,530 | 10/1956 | Pladanius | 51/214 |
| 3,956,856 | 5/1976 | Yonkers | 51/59 R |
| 4,280,378 | 7/1981 | Levine | 437/2 |
| 4,528,777 | 7/1985 | Bernstein et al. | 51/285 |
| 4,716,689 | 1/1988 | Friel | 51/285 |
| 4,718,200 | 1/1988 | Miquelot | 51/211 R |
| 4,934,110 | 6/1990 | Juranitch | 51/214 |

*Primary Examiner*—Maurina T. Rachuba
*Attorney, Agent, or Firm*—Connolly & Hutz

[57] ABSTRACT

Both facets of a double faceted blade are simultaneously sharpened as the facets are moved across a first pair of planar abrasive coated surfaces crossing to form a vertex and positioned to establish a total included angle at the vertex nominally equal to the intended total included angle of the edge facet. A guide structure contacts and aligns the blade so that the centerline of the blade is positioned at or near the bisection of the included angle of the abrasive surfaces. The guide structure is one or more rotatable members.

33 Claims, 4 Drawing Sheets

METHOD AND APPARATUS FOR KNIFE AND BLADE SHARPENING

CROSS-REFERENCE TO RELATED APPLICATION

This application is a continuation-in-part of application Ser. No. 901,213, filed Jun. 18, 1992, now abandoned.

BACKGROUND OF THE INVENTION

Many of the wide variety of knife sharpeners that have been developed in the past fail to give truly sharp edges or even consistently good edges because of the lack of good angular control during the sharpening process. This is particularly true of V notch type sharpeners intended to sharpen both edge facets simultaneously. Manual means for sharpening in particular are unsatisfactory because existing V type sharpeners do not have an integral control of the angle but depend on the user to hold the blade "vertically" while sharpening. To develop a really sharp edge it is critically important that the blades pass over the abrasive surface stroke after stroke at the same precise angle. Even very small variations in the angle in successive strokes will prevent the formation of a truly sharp edge. The finest edges can be produced only if the angle is consistent stroke to stroke within ½ degree. That is of course impossible without a precise means to guide the blade.

Even narrow slots commonly provided for angle control do not work since blades are tapered and their thickness varies widely from the handle to the tip. Thus, where the blade is thinner along its length than the width of the slot by only a few thousandths of an inch there is inadequate angular control to develop a truly sharp edge. If one attempted to design the slot for tight conformity to the blade thickness at one point along the length of the blade other parts of the blade would be too loose or they would be too thick to get into the slot.

The prior art includes sharpeners such as illustrated in FIG. 15 and FIG. 16 wherein wheels of hardened metal, ceramic, or oxides are placed into an overlapping configuration forming a "V groove" through which the edge of a blade is passed in intimate contact with the wheels. This type sharpeners depends upon a scraping action at the edge of the disk to remove metal from blade and the disk is mounted on a shaft so that fresh "edges" can be exposed by rotating the disk after each sharpening. In time the edges of the disk become rounded and the sharpener is ineffective. They offer no angular control for the blade or at best a slot is provided as shown in FIG. 15 which is substantially wider than any blade intended to be sharpened. Consequently the angular control is poor and the disk edges wear rapidly leading to a short useful life for the sharpener.

Another V type sharpener is the common crock stick sharpener such as described in U.S. Pat. No. 4,912,885 which forms a V shaped slot by using a pair of crossed ceramic rods. In this configuration the knife edge is pulled through the crotch formed by the two rods. Commonly the rods are made of abrasive material such as sintered aluminum oxide. The sharpening action is largely from the action of abrasives along a linear line on the rod in contact with each facet. The facets are not in contact with an area of abrasives but like the wheels only in contact with a line. Again there is no angular control and any rotational motion of the blade (deviation from vertical) or any tilting of the blade horizontally stroke to stroke will reduce substantially the chances of getting a sharp edge on the blade.

U.S. Patent Nos. 1,894,579 and 1,909,743 describe a large V type sharpener that uses a series of flat individual rectangular abrasive bars to form a V slot but again there is no provision for angular control of the blade as it is pulled through the sharpener. Because this sharpener uses relatively soft abrading elements that wear readily losing their contour, the angle of the V must be changed periodically to expose an area of the bar with good geometry. This like other V sharpeners requires a skillful operator to hold the blade "vertical"—an impractical requirement. In all of these prior art sharpeners it is intended that both of the edge-forming facets be sharpened or the blade is passed through the slot. For this to occur the angular alignment of the blade centerline with the centerline of the V notch must be perfect stroke after stroke, as illustrated in FIG. 17. Clearly that is not practical without some sort of guide. Any angular variation stroke to stroke will result in reforming each of the facets at a new and different angle. This tends to dull the edge or malform it rather than sharpen it to a keen edge.

Those V notch sharpeners where the V is formed by the circumference of two wheels have the disadvantage that the facets are formed to the same shape as the wheel. As mentioned above this shaping results from scraping or skiving metal off of the facets as they move across the sharp edges of the wheels. Because the wheels are circular, the facets become concave that is curved to the same negative radius as the wheels. This creates a weak unsupported facet geometry behind the edge as shown in FIG. 18.

Straight facets as shown in FIG. 17 are stronger and are to be preferred over the concave facets of FIG. 18.

Still better and stronger are convex facets (Gothic arch structure) as shown in FIG. 19.

SUMMARY OF THE INVENTION

An object of this invention is to provide an improved method and apparatus for the sharpening of knives and blades.

A further object of this invention is to provide an improved arrangement of guides and abrasive surfaces to implement the improved method and apparatus in either manual or motor assisted configurations.

It will be shown surprisingly that with the unique improvements discovered in this invention, notch sharpeners can create precision facets of any shape including the ideal Gothic arch construction of FIG. 15. The geometry of the special abrasive coated pads disclosed in this invention are much more effective and efficient than the prior art designs both in terms of metal removal rate and precision of the facets created. Their special geometry and construction makes it possible and practical to obtain special facet contours to add increased and optimum support to the blade edge. Hence, it is possible to create an edge quality and shape far superior to any manual prior art sharpeners. This invention includes importantly unique blade guides consisting of one or more unique wheels or rollers to provide extremely accurate and non-scraping guides for the blades when sharpened in this improved V type sharpener configuration.

It is a further object of the invention to provide unique single and multistage sharpeners that incorporate these improvements and can create unusually sharp edges. Preferably these sharpeners incorporate special diamond coated abrasive pads that unlike conventional solid abrasives will maintain their geometry in use to produce such sharp edges.

THE DRAWINGS

DETAILED DESCRIPTION

Figure 2:
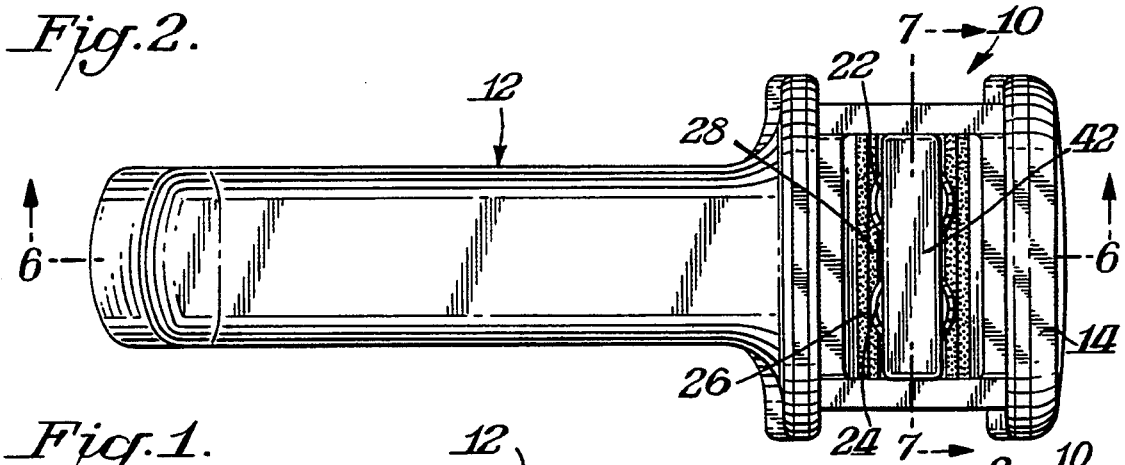
FIG. 2 is a top plan view of the sharpener shown in FIG. 1.
Figure 1:
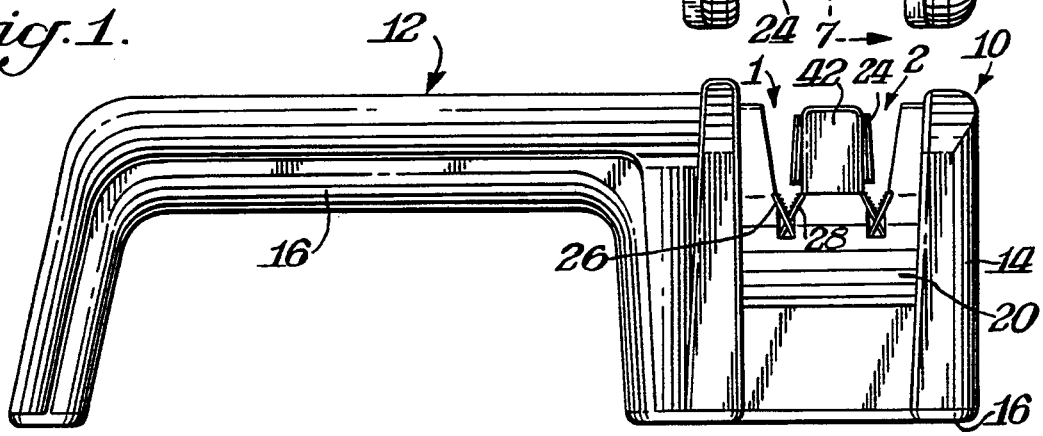
FIG. 1 is a left side elevational view of a two-stage manual sharpener in accordance with this invention with the right side being a mirror image thereof.
Figure 3:
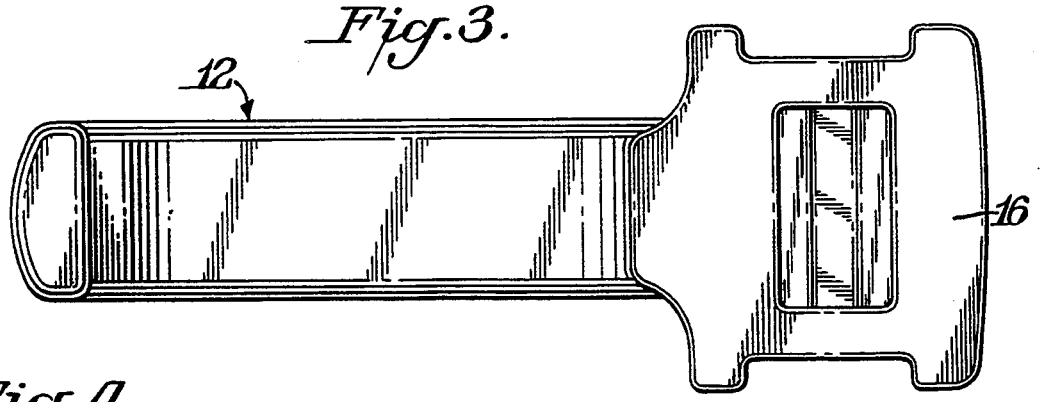
FIG. 3 is a bottom plan view of the sharpener shown in FIGS. 1–2.
Figure 4:
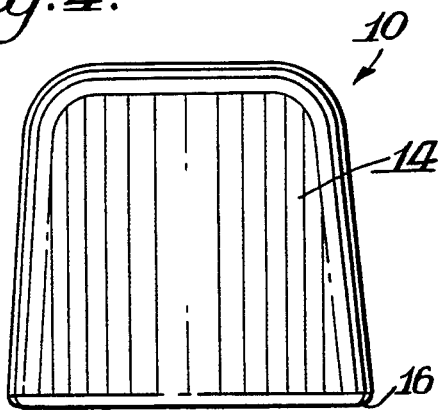
FIG. 4 is a front elevational view of the sharpener shown in FIGS. 1–3.
Figure 5:
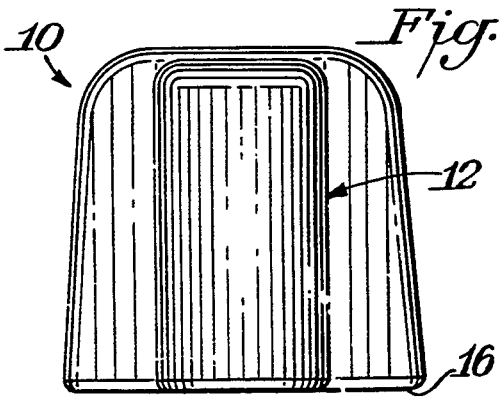
FIG. 5 is a rear elevational view of the sharpener shown in FIGS. 1–4.
Figure 13:
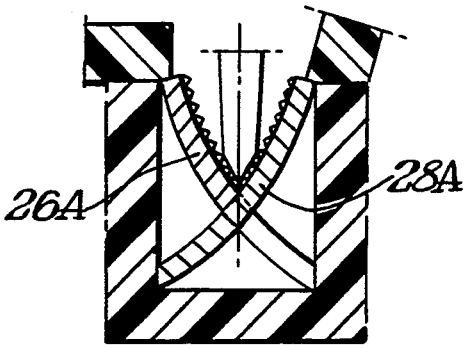
FIG. 13 is a view similar to FIG. 12 of a modified form of sharpening pads.

One embodiment of this invention is illustrated by FIGS. 1–3 which is a two stage manual V-type sharpener. Each stage includes unique abrasive coated interdigitating members similar to those shown in FIGS. 8 and 9. These members have comb like structures that can interdigitate because their teeth are slightly smaller in width than the intervening slots or spaces into which the opposite mating teeth can fit. The members are arranged to cross at an angle equal to the desired total edge angle to be generated on the facets that terminate at and support the blade edge. Shaping of the facets is accomplished by the abrasive, preferably diamonds, coated on the surface of unique rigid members. The abrasive coated structure can be of any shape such as planer or convex, or the concave shape as shown in FIG. 13. The concave structure will create a convex shape on the facets of a blade resulting in a superior strong Gothic arch shape to support and strengthen the edge being formed. In order to provide an accurate guide for blades stroke-after-stroke this invention includes one or more wheel-like guides which on their circumference can be thin disk like, or thicker with a cone shaped or otherwise contoured surface with a preferred geometry along its surface perpendicular to its radii. That geometry might for example be selected to hold blades essentially vertical although blades can vary substantially in design and especially in their thickness and the angle of their facets where they contact the wheel-like guides.

It is less important that an individual blade be held in truly vertical position than it is to hold the blade at the same angle at any given point along its length on each successive strokes, stroke after stroke. The angle need not be the same angle at each point along the blade edges. If the blade axis is not absolutely "vertical" at a given point along its length, that is not truly bisecting the total included V angle created by the abrasive members, left and right, the facets will not have precisely the same angle relative to the axis of that blade. The blade would be exactly bisecting the total included angle of the V slot when its centerline which is the line from the edge of the blade to the center of its thickness at the back of the blade is coincident with the bisection line of the V slot angle. Exact bisection is not essential to the precision of the edge being generated, but is important that these angular relationships be the same on each successive sharpening stroke.

Figure 10:
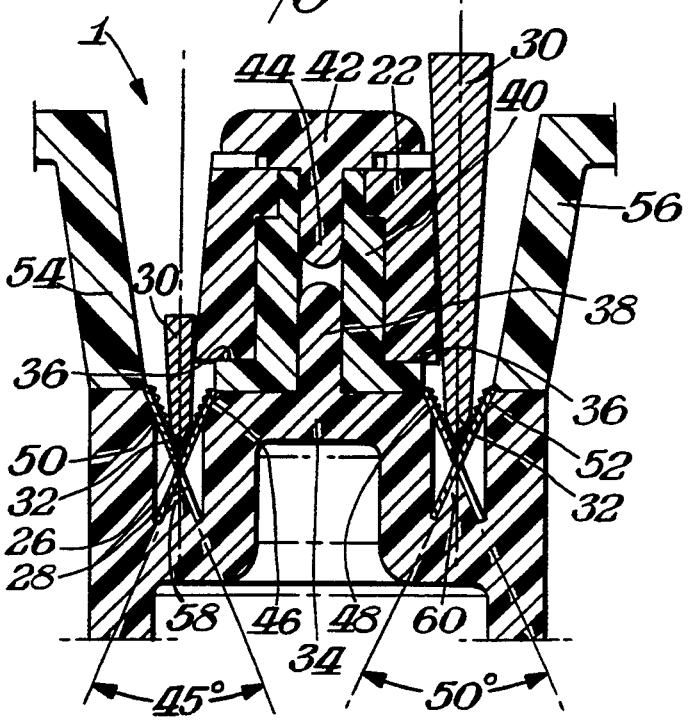
FIG. 10 is a fragmental enlarged cross-sectional view similar to FIG. 7 showing knives of different sizes in the sharpening mode.

It was discovered that a two stage sharpener such as illustrated in FIGS. 1–3 can be designed so that the same wheel or wheels used to guide the blade in one sharpening slot can also guide the blade in the second slot as shown in FIG. 10. The knife is positioned during sharpening so that it is continually pressed against a surface of the wheel as it is passed through each sharpening slot.

The design of the abrasive coated members will ideally be such as to provide enhanced sharpening action along that portion of the facets distant from the edge where metal thickness between facets is the greatest and where it is desirable to remove metal most efficiently and completely during sharpening. Effective metal removal in that section ensures "relief" for the metal removing process occurring closer to the edge and at the edge itself. This adds to the quality and perfection of the edge being created. A knife that has not been sharpened before in this improved sharpener may have been sharpened first at the factory or by the owner at a larger angle requiring removal of substantial quantity of metal along the upper portion of the facet in order to bring the facets to the included angle of this improved sharpener. For this reason too it is important to have a maximum ability to remove metal from that portion of the facet. The design of the unique sharpening members in this invention provide these important advantages. While the principles described here apply directly to manual V shape sharpening configurations, the special abrasive coated rigid members disclosed here can be synchronously mechanically driven to move in a number of planer or linear directions thus enhancing the sharpening action.

Spheres can be used like the wheels described here to provide a guide for the blade. Likewise a plane of spheres or wheels can be used as a knife guide with sharpeners including those that do not have the V slot configuration.

Pads of low friction materials such as Teflon, acetal or polyolefin can be used but they would tend to scratch the blade.

The method and apparatus of this invention provide for the skilled or unskilled an improved and low cost means of creating a cutting edge of unusually sharpness and perfection, essentially free of microserrations of the type found on many blades sharpened by other means.

Figure 11:
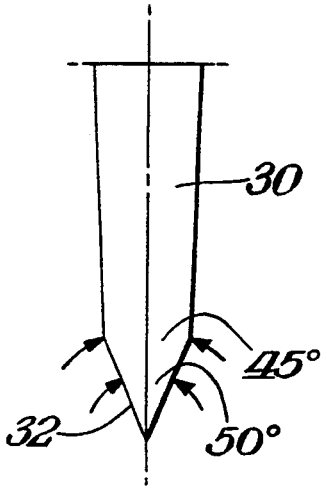
FIG. 11 illustrates a knife edge that has been sharpened by the two stage sharpener of this invention.
Figure 19:
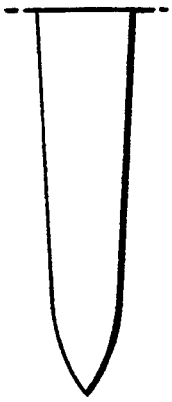
Fig. 19. (Prior Art)

One embodiment that incorporates certain of the improvements of this invention is illustrated in FIGS. 1–3. This is a manual two stage sharpener which can be steadied by its handle with one hand while a knife held in the other hand can be sharpened by pulling its blade successively through the V shaped slots in stages 1 and 2. The V slot in stage 1 will generally be a smaller angle than the V slot in stage 2. This creates a double bevel on the facet as illustrated in FIG. 11. In this manner the second stage sharpens closer to the edge and in general a finer grit abrasive will be used in the second stage to refine and perfect the edge geometry. In a simpler configuration this sharpener need have only one sharpening stage. The second stage gives the advantage that a finer more perfect edge can be obtained because finer diamonds can be used and because prior sharpening in the first stage at a different—smaller angle—provides relief for the metal removal in the second stage. It has been demonstrated that better edge geometry can be obtained if the final sharpening occurs only very close to the edge and if it is unnecessary in that stage to remove excessive amounts of metal. By sharpening at a larger angle in stage 2, the resulting edge takes on a shape close to the Gothic arch as illustrated in FIG. 19. It is possible also to provide a third stage to sharpen at an angle larger than in stage 1 or 2 and thereby create a triple bevel facet—a shape still closer to a perfect Gothic arch. The Gothic arch structure gives more support behind the edge and as a result the edge will stay sharp longer. It is possible to design the sharpener with a single stage (as later described with respect to FIG. 14) where the V angle can be changed during the sharpening process. For example, one can start the sharpening with a smaller angle and through use of a mechanical linkage progressively increase that angle as the sharpening progresses. One might start with a total included angle for example of 40° and increase that angle to 50° total at the end of the sharpening. This would generate near perfect Gothic arch.

This inventor has demonstrated the critical importance of maintaining the blade at the same angle stroke after stroke during the sharpening process in order to create a perfect edge. It has been found that a suitably designed wheel, cone, cone section or contoured cylinder, properly positioned, can provide a uniquely simple means of maintaining a highly reproducible angle for a wide range of knives in single or two stage sharpeners. FIG. 1 and FIG. 10 show one or more truncated cones or shaped wheels that extends above and into the upper portion of the V slots formed by the abrasive coated members of a two stage sharpener. In use the blade when in each slot rests against this wheel or truncated cone as shown in FIG. 10. The geometry of the wheel or cone-like rotatable member is adjusted to accommodate a variety of blades of different thickness, width and different included angle between the facets of the blade.

Blades vary widely in their thickness, width, and total included angles of the facets. For example, pocket knives can be relatively narrow yet quite thick at their back (the thickest part of the blade); the total angle of the faces of small pocket knives commonly can be 12°, some hunting knives are larger than 12°, while cooks knife commonly are as low as 3°. Other popular knives fall in the middle of that range. Knives differ also in the thickness of the blade immediately behind (adjacent to) the facets that create the edge. Fine cutlery may be only a few thousandths of an inch thick at that point while butcher blades or cleavers are commonly much thicker to provide extra strength.

It has been found that wheels suitably contoured provide a unique and reproducible means for angular control for virtually all of the commonly available blades. Because some blade are very narrow it is desirable to provide a guide very close to the vertex of the V notch. Blades of small pocket knives may be only 0.2 inch wide; therefore it is desirable to provide support at least that close to the vertex. A chefs blade can have a width of 2 inches or more and it is generally thinner than a pocket knife immediately behind the facets. A very thin disk-like wheel located 0.2 inch above the vertex of the V can be designed so that a thick bladed pocket knife held against its diameter would align its axis perfectly vertical (that is bisecting the V angle). However, if a thin chefs blade is then placed against the diameter of such a thin disk so located, the axis of the chefs blade would be substantially off vertical. While as explained earlier, it is not essential that the blade axis be absolutely vertical during sharpening, it is desirable to be as vertical as possible in order to minimize the time it takes to sharpen. Further an edge with equal-angled facets cuts straighter.

It has been found that by using a cone shaped wheel as shown in FIG. 10, it is possible to optimize the alignment of the axis of a variety of blades with the axis of the V slot. While desirable to align the blade near vertical the bisection of the total included angle formed by the V slot, it is critical that the angular alignment of the blade axis be extremely reproducible for the same knife—stroke after stroke. A truncated cone shaped wheel accomplishes this well. FIG. 10 shows how the narrow blade in the left slot contacts such a cone near its base while the wider (longer in cross section) blade in the right slot contacts the cone at its top edge. It is clear from this FIG. 10 that the axis of the wider blade would be further to the left and less vertical if that blade depended upon the base of the cone for its support.

It has been demonstrated that one good geometry is a cone about 0.5 inches in height with a diameter at its base appropriately selected to vertically align narrow blades and where the facet of the cone is at an angle of about 2 degrees to its axis. If the V slots in a two stage sharpener are separated center line to center line by for example 0.7 inches, and the base of the cone is 0.2 inches above the vertex of the V slots, a good diameter for the base of the cone is on the order of 0.655 inches. This is mathematically the difference of the centerline to centerline distance, (0.700″) less the thickness +(0.045″) of an average narrow pocket knife. Two degrees is a convenient slope for the cone as that angle approximates the median slope of the facets of a wide variety of popular knives. For a specialized class of knives such as hunting blades, the slope could be larger or the diameter altered to provide an even more accurate alignment of the blade axis. For some knife combinations a slightly concave surface could be superimposed on the conical geometry for a better compromise. The advantage of such wheels for control of the blade angle during sharpening are dramatic. Without such angular control obtaining a truly good, sharp edge is a matter of chance and luck. With such guides, V slot sharpeners in particular quickly produce razor sharp edges. The wheels offer a major advantage over static guides in that the former will not scratch the facets of the blade as it rolls over the wheel circumference. Static guides, even made of plastic, will surprisingly in use burnish the facets of the blades because of the sliding friction and abrasion—albeit slight—especially where the burnishing on the blade is perpendicular to the direction of the final grind and polish lines on the facets of the blade. Preferably the wheels or cones described herein are made of plastic so as to minimize the opportunity for scratching the blade under all conditions.

Static guides can be used to provide a similar angular control but for them to be as effective as the cone wheels they must have a sloped facet with the same contour and height as the cone face. A further enhancement of this invention includes a means to adjust and optimize for each blade the separation of the wheel or cone axis from the center line of the V notch. Simple mechanical means can be incorporated to permit this adjustment to be made manually for each blade being sharpened in each V notch.

Figure 14:
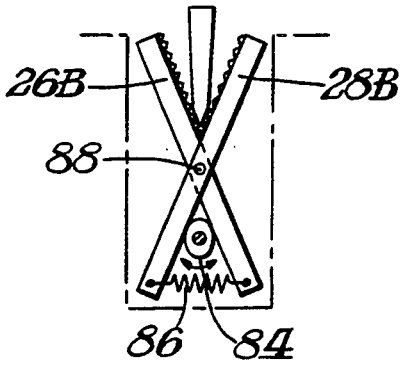
FIG. 14 is a cross-sectional view of an alternative embodiment of this invention for the intermeshed sharpening pads.
Figure 16:
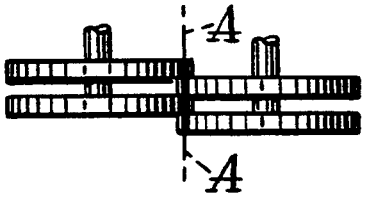
Fig. 16. (Prior Art)
FIG. 16 is a plan view of the prior art sharpener shown in FIG. 15.
Figure 15:
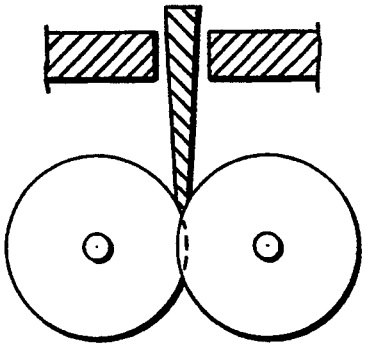
Fig. 15. (Prior Art)
FIG. 15 is an elevational view partly in section of a portion of a prior art sharpener.
Figure 17:
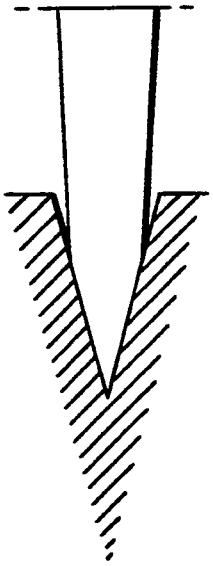
Fig. 17. (Prior Art)
FIGS. 17–19 are elevational views of prior art sharpening techniques.
Figure 18:
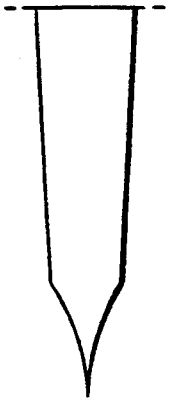
Fig. 18. (Prior Art)

To reduce the number of stages and yet obtain a Gothic arch type contour on the blade such as shown in FIG. 19, it is possible as mentioned earlier to steadily or intermittently vary the included angle of the V notch curing the sharpening process, using an increasingly larger angle as the sharpening progresses. This can be accomplished with a simple eccentric cam such as shown in FIG. 14. By rotating the cam the angular alignment of the abrasive coated members can be changed thereby altering the included angle between the abrasive surfaces. The multistage approach described here earlier has the advantage over the variable angle single stage that it allows one to change or reduce the grit size while using a larger angle in finishing the final edge.

Figure 12:
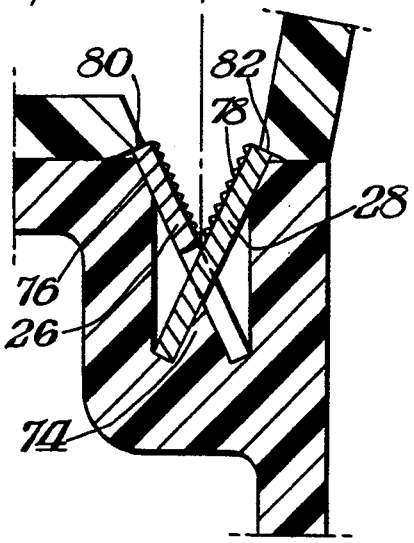
FIG. 12 is an enlarged cross-sectional view illustrating the intermeshed sharpening pads retained in the sharpening head.

Another simpler means of generating a Gothic arch geometry at the edge is to use abrasive coated concave members as in FIG. 13 instead of planar members of FIGS. 10 and 12. The abrasive coating, preferably diamonds, can be deposited with a coarse grit distant from the edge where more metal must be removed and with a finer grit at the edge where there is need for more precise abrasion and usually where there is less metal to be removed during sharpening.

Figure 8:
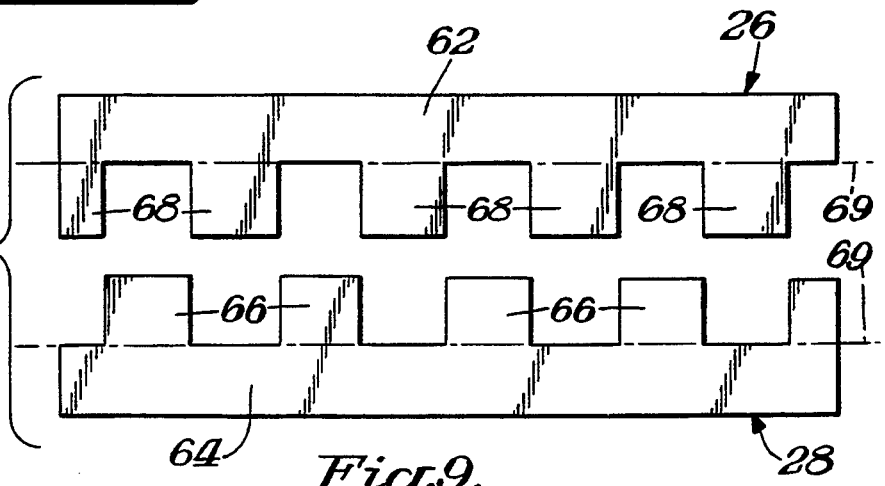
FIG. 8 is a bottom plan view of the comb shape sharpening pads used in the sharpener of FIGS. 1–7, before the pads are assembled together.
Figure 9:
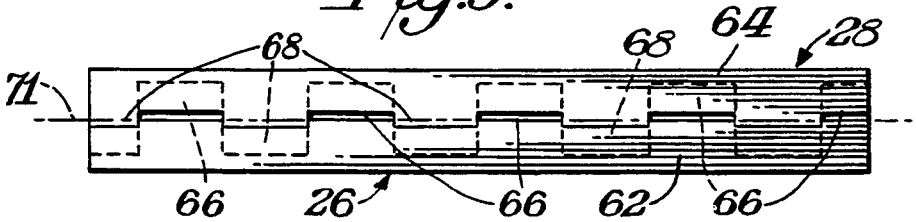
FIG. 9 is a top plan view of the sharpening pads of FIG. 8 in their assembled condition.

Unique and improved sharpening members have been developed by this inventor for V shaped notch sharpeners that are made as abrasive coated one-piece single comb-shaped rigid metal strips with notches and teeth. An example is shown in FIG. 8 with teeth and notches designed to interdigitate as seen in FIG. 9. In this configuration rigid metal strips are coated with diamond abrasives secured with electrodeposited metal. The diamonds are required only on the areas of the members where metal must be removed during sharpening. The teeth must have a width smaller than the corresponding slots of the mating member. The depth of the teeth and slots must be such than when mated they do not prevent or interfere with the formation of the V structure of the required angular geometry. Further to realize the full benefits of this invention, the distance of the base line 69 (FIG. 8) of the teeth from the vertex of the interdigitating abrasive coated members would be less than the length of the facet being sharpened as suggested by FIG. 9. For most blades a distance from the base line 69 to the vertex 71 of about 0.020 inch is appropriate and ideally that distance will be less than 0.040 inch. It is desirable that there be sufficient spacing between the base line of the teeth of at least one member and the vertex to allow swarf (metal filings resulting from sharpening) to fall through that spacing and to thus avoid "loading up" the abrasive surface at or near the vertex where the greatest geometric and angular precision is required. However it is desirable that the base line of the teeth be close enough to the vertex that the unbroken areas of the member above the base line will be abrading the upper part of the facet of thicker blades with large facets. It is important to be able to remove metal rapidly in resharpening that part of the facets to restore a badly damages edge or to place a smaller angle on a blade previously sharpened at too large an angle by other means. The unique structure of these comb-like members allows highly precise angular and geometric control where they cross and where the fine edge must be created. The rigid supporting metal structure of FIG. 9 can be manufactured with great planarity and it can in turn be supported by ultra flat molded structures or by other means. The use of diamonds as the abrasive is highly important because of their uniqueness in resisting wear and unique ability to hold the geometric shape of their surface even under prolonged use. It is important to emphasize that the comb-like diamond coated member sharpens through the abrasive action of the diamonds and unlike the prior art disk type V sharpeners that depend upon their sharp edges to remove metal, there novel members do not depend upon for metal removal.

No other abrasive including materials as hard as alumina and cubic boron carbide can hold their shape as well as diamonds. Where there would be excessive wear over extended periods of time, provisions in sharpener design can be made for the rapid replacement of these members. The fact that the diamond abrasives exist on the members as a thin layer and because their resistance to wear is extraordinarily better compared to bulk abrasives such as used in all prior art V notch type sharpeners contribute critically to the ability of this improved structure to sharpen so well and to hold its geometry much longer than any prior art V notch sharpeners. The fact that this design uses a large area of abrasives rather than just a line or edge contact for sharpening is also important.

To accelerate the sharpening process with these improvements, it is possible to include mechanical means to oscillate the combs in a direction parallel to the axis of their teeth. Motion of the abrasives in this direction together with the manual motion of the knife through the slot will speed up the sharpening process. Linear or orbital motions of the abrasive interdigitating members along other axis are also possible to accelerate the sharpening process. With concave combs as in FIG. 13 or with convex combs linear motions parallel to the axis of the teeth in such members are not feasible but reciprocating motions parallel to the edge of the blade or oscillating motions about an axis are practical.

Optimum results depend upon the use of diamond abrasive particles, control of the geometry of the member teeth, and exacting control of the axis of the blade at all times as described herein.

Parent application Ser. No. 901,213 the details of which are incorporated herein by reference thereto discloses the use of rollers as guides for the blade of a cutting tool to guide the cutting edge facet into proper position with respect to the sharpening member. The present invention provides advantageous variations of those concepts.

FIGS. 1–7 illustrate one embodiment of this invention wherein the sharpener is manually operated. It is to be understood, however, that the concepts of this invention may be practiced with an electrically or motor operated sharpener. The combs, for example, may be electrically reciprocated. As shown in FIGS. 1–7 the sharpener 10 includes handle 12 which is part of a housing for holding the sharpening sections. The housing may be formed in any suitable manner such as by an upper housing 14 and a lower housing 16 joined together at seam or joint 18. The housing in the sharpening section would have a contoured panel 20 and would also include the lower housing 16 and upper housing 14. Upper housing 14 extends substantially the entire height of the sharpening section. Guide wheels having roller surfaces 22,24 are located in each of the sharpening stages 1,2. As best shown in FIG. 1, the guide rollers extend above the abrasive sharpening members 26,28. Thus, as shown in FIG. 10 the knife blade 30 would be placed against the respective rollers with the edge 32 disposed in the V formed by the sharpening members or pads 26,28.

Figure 6:
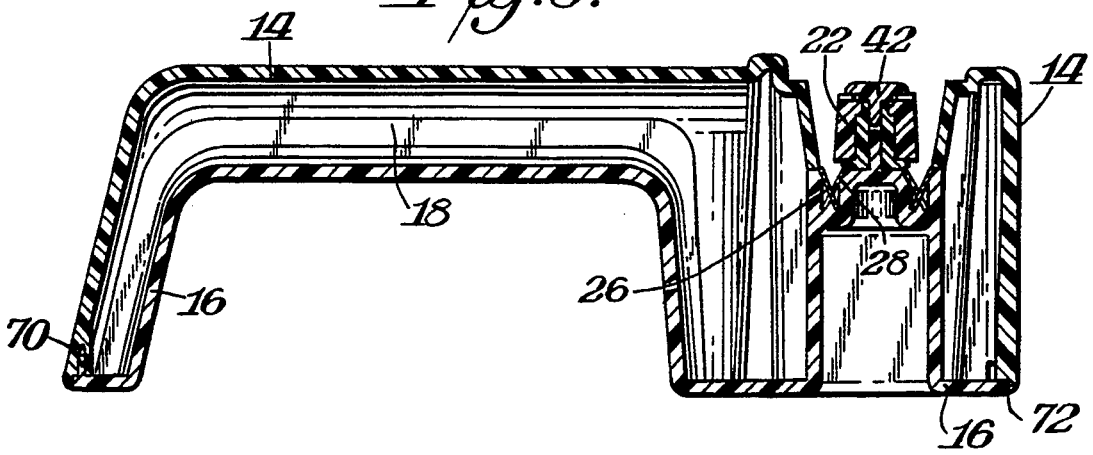
FIG. 6 is a cross-sectional view taken through FIG. 2 along the line 6—6.

FIG. 6 illustrates the mounting of rollers 22,24 above the abrasive contact members or sharpening pads 26,28. As shown in FIGS. 6 and 10 a pedestal support member 34 is formed within the sharpening section. Pedestal 34 includes support shoulders 36 and upwardly extending projection 38. A roller bearing 40 is mounted on each shoulder 36. The wheels or rollers 22,24 are held in place by cover member 42 (FIG. 7) which has a downward projection 44 extending between the roller bearing supports 40.

As best shown in FIG. 10 each corner of the pedestal or support member 34 has a bevel 46,48 so that the sharpening members 26,28 may rest against the respective bevel at the appropriate angle. Similarly, the inner surface of the housing includes a bevel 50,52 against which the respective sharpening member rests. The housing walls 54,56 taper outwardly to provide easy entrance for the respective knife blades into the sharpening stages 1 and 2. The lower portion of the housing includes a pair of V shaped projections or risers 58,60 against which the sharpening members 26,28 are disposed. The V shaped extensions in connection with the bevels establish the angle formed by the intersecting sharpening members. Thus, for example, a 45° angle is established by V shaped extension 58 and a 50° angle is established by V shaped extension 60.

Figure 7:
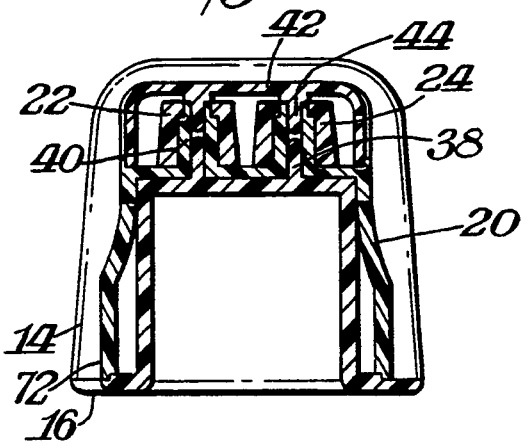
FIG. 7 is a cross-sectional view taken through FIG. 2 along the line 7—7.

As shown in FIG. 6 upper housing 14 and lower housing 16 are also held in proper position with respect to each other by means of a post 70 extending from the lower housing 16 into a corresponding hole in the upper housing 14. FIG. 7 also illustrates a shift-lap engagement joint 72 at the line of connection between upper housing 14 and lower housing 16.

FIG. 7 further illustrates pin or extensions 44 from the cover 42 which fictionally engage in the bearing roller support 34.

FIGS. 8–9 illustrate in greater detail the sharpening members 26,28. As shown therein each sharpening member is in the form of a comb having a pad or base portion 62,64. Base portion 64 has a plurality of fingers or teeth 66 while base portion 62 also has a plurality of fingers or teeth 68. The respective fingers are dimensioned and located for being intermeshed or crossing so as to form the interdigitated assembly illustrated in FIG. 9 and also illustrated in the various figures, such as FIGS. 1, 6, 10 and 12–14.

FIG. 11 illustrates the edge 32 of blade 30 resulting from the use of sharpener 10. As shown therein a compound angle of 45° and 50° results in edge 32. Advantageously, any conventional sized blade could be sharpened by sharpener 10. FIG. 10, for example, illustrates a pocket knife size blade to be in the sharpening stage 1 while a much larger butcher carving knife is illustrated as being in stage 2. The guide wheel rollers 22,24 assure proper positioning of the respective blades 30 to dispose the edge in the intersection formed by the interdigitated sharpening members 26,28 which form Gothic shaped sharpening pads. As the knife blade is moved through a sharpening stage the blade first contacts one roller and then the other to always remain in contact with at least one roller during the sharpening action.

FIG. 12 illustrates one form of positioning the sharpening members. As shown therein a V shaped riser 74 is located between the intermeshed pads at the lower portion thereof. The upper portions thereof rest against bevels 76,78 and against beveled surfaces 80,82 to firmly hold the sharpening members in their proper position at their desired angle.

FIG. 13 illustrates a modified arrangement wherein the sharpening members 26A and 28A are concave shape forming a more Gothic shape.

FIG. 14 illustrates a further alternative wherein the angle formed by the intermeshed or interdigitated sharpening pads 26B and 28B is controlled by cam means so as to permit the angle to be varied. Specifically, a rotatably mounted cam 84 is shown disposed between the lower portion of the cross sharpening members. The ends of the sharpening members are urged toward each other by any suitable biasing means such as a spring 86. Pivot pin 88 is provided to support the abrasive coated members 26B and 28B when the sharpening members are moved in accordance with the rotation of cam 84.

It is to be understood that the specific details of the sharpener 10 regarding the construction of the sharpener are merely for exemplary purposes. The specifically illustrated sharpener is a manual sharpener where the sharpening members are stationarily mounted and the sharpening action takes place by guiding the knife edge across the V formed by the intersection of the intermeshed sharpening members. The sliding movement is facilitated by contacting the knife blade with the roller guides. It is to be understood that the invention may also be practiced with a motor assisted sharpener and the invention is thus not intended to be limited to a manual sharpener.

It is also to be understood that the invention may be practiced wherein the guide wheel or cone section having roller surface 22 or 24 may be vertically adjustable to move closer to or further from the abrasive surface.

Additionally, the invention may be practiced where only one facet at a time is sharpened. This can be done in any suitable manner, such as by having the same interdigitated pads, but providing abrasive particles on only one of the pads. Alternatively, only a single abrasive coated member may be provided which is at an angle, thus forming only one-half of a V.

A particular advantage of the invention is the use of diamond abrasive particles which is particularly effective for sharpening non-ferromagnetic knives, such as ceramic knives. Where ferromagnetic knives are sharpened the invention may be practiced by providing a magnet in the sharpening section to collect the metal filings.

What is claimed is:

1. An apparatus for sharpening an ledge of an elongated blade comprising a housing having an exposed sharpening section, a first pair of rigidly stationarily mounted members having abrasive coated surfaces in said sharpening section, said surfaces being juxtaposed each other, said surfaces crossing to form a rigid structural vertex and to establish an angle therebetween, blade guide means in said section having a guide surface directly above said abrasive surfaces disposed solely on one side of the bisection line of said angle to contact and align the blade so that the centerline of the blade established from its edge to the center of its thickness at its back is positioned generally at said bisection line of said angle of said abrasive surfaces, said guide means including at least one rotatable member which is otherwise rigidly stationarily mounted and has an outer guide surface for making rolling contact with the blade whereby said guide means guides the blade as the blade moves along said surfaces and said rotatable member being maintained in fixed relationship to said abrasive surfaces independently of the dimensions of the blade.

2. An apparatus according to claim 1 wherein said rotatable member is a section of a cone mounted to rotate about its central axis as a consequence of motion of the blade in contact with one or more points of the arcuate surface of said cone.

3. An apparatus according to claim 2 wherein said cone has a side taper of 2–3 degrees.

4. An apparatus according to claim 1 wherein said rotatable member has an arcuate outer surface selected from the group consisting of a cone, truncated cone, and cylinder with a superimposed secondary contour thereon to angularly align the blade.

5. An apparatus according to claim 1 where a mechanical means is provided to alter the total included angle of said abrasive surfaces.

6. An apparatus according to claim 1 where the lateral position of said rotatable member can be changed by a mechanical means to alter the distance from its surface that contacts the blade to the bisection line of the included angle of said two abrasive surfaces.

7. An apparatus according to claim 1 including a second pair of said planar abrasive coated surfaces crossing to form a vertex and to set at a slightly different total included angle than the said first pair.

8. An apparatus according to claim 2 wherein the base of said cone is disposed toward the vertex of said abrasive surfaces.

9. An apparatus according to claim 1 wherein said guide means comprises a plurality of said rotatable members.

10. An apparatus for sharpening simultaneously both facets of a double faceted blade comprising a housing having an exposed sharpening section, a first pair of abrasive coated surfaces in said sharpening section, said surfaces crossing to form a vertex and establish at a total included angle nominally equal to a predetermined angle intended to be the total included angle of the edge facets, blade guide means in said section to contact and align the blade so that the centerline of the blade established from its edge to the center of its thickness at its back is positioned for near the bisection of said included angle of said abrasive surfaces, said guide means including at least one rotatable member whereby said guide means guides the blade as the facets are moved across said surfaces, a second pair of said planar abrasive coated surfaces crossing to form a vertex and to set at a slightly different total included angle than the said first pair, said rotatable member being of a size to extend from a point near the bisection line of the included angle of said first pair of said planar abrasive coated surfaces to a point near the bisection line of the included angle of said second pair of said planar abrasive coated surfaces.

11. An apparatus according to claim 10 where the said rotatable member is of a size equal to the distance from the bisection of the included angle of said first pair of said planar abrasive coated surfaces to the bisection of the included angle of the second pair of said planar abrasive coated surfaces less a distance of about 0.045 inch measured at a point approximately 0.2 inches above the vertex of the said first and second pair of abrasive coated surfaces.

12. An apparatus for sharpening an elongated edge of an object comprising a housing having an exposed sharpening section, two non-movably rigidly mounted members in said sharpening section, each of said members being a planer comb-like structure having an elongated base portion, a plurality of co-planar integral teeth extending outwardly from said base portion, said teeth being spaced from each other by slots therebetween, at least one of said members having an abrasive coated surface on at east its said teeth, said teeth of each of said members interdigitating with said slots of the other of said members to form an angle between said interdigitated teeth, said angle having a bisection line with an elongated interrupted sharpening surface on at least one side of said bisection line, and each of said teeth from one of said members being juxtaposed at least one tooth from the other of said members to form said elongated interrupted sharpening surface with a plurality of abrasive surfaces and a plurality of open areas whereby the edge being sharpened is subjected to repeated alternating contact with an abrasive surface as the object is moved through said sharpening section.

13. An apparatus according to claim 12 wherein a mechanical means is included to vary the included angle between said abrasive surfaces of said members.

14. An apparatus according to claim 12 wherein the base line of said teeth of at least one member is established at a distance not greater than 0.040 inch from the vertex created by the line intersection of said abrasive coated surfaces of said members.

15. An apparatus according to claim 12 wherein the object is a knife blade and the surface of said abrasive coated surfaces of said members is non-planar.

16. An apparatus according to claim 15 wherein said abrasive coated surfaces of said members is sufficiently concave to create a gothic arch like cross section at the knife edge.

17. An apparatus according to claim 12 including at least one rotatable guide member located near said crossed members to guide the object as the edge is moved across said abrasive coated members.

18. An apparatus according to claim 17 wherein said rotatable member has an arcuate guide surface.

19. An apparatus according to claim 18 wherein said rotatable member is a section of a cone mounted to rotate about its central axis as a consequence of motion of the object in contact with one or more points of said arcuate surface of said cone.

20. An apparatus according to claim 19 wherein the base of said cone is disposed toward the vertex of said abrasive surfaces.

21. An apparatus according to claim 12 wherein said base portions are disposed above said teeth and are exposed in said sharpening section, said teeth have outer ends disposed below the intersection forming said angle of said interdigitated teeth, said member having said abrasive coated teeth also having its base portion with an abrasive coated surface.

22. An apparatus according to claim 21 wherein each of said members has an abrasive coated surface on its teeth and its base portion.

23. An apparatus according to claim 22 where said teeth and base portions of both of said members are entirely coated with an abrasive coating.

24. An apparatus according to claim 12 wherein each of said members has an abrasive coated surface on its teeth.

25. An apparatus according to claim 12 including a guide surface in said sharpening section for guiding the object during the movement of the object through said sharpening section.

26. A method of sharpening an edge of an elongated blade comprising providing a sharpener having a pair of rigidly stationarily mounted members having abrasive coated surfaces juxtaposed each other and crossing to form a rigid structural vertex at an angle therebetween, sliding the blade against a rotatable guide surface located directly above the abrasive surfaces and located solely on one side of the bisection line of the angle to contact and align the blade so that its centerline established from the edge of the blade to the center of its thickness at its back is positioned generally at the bisection line of the angle of the abrasive surfaces, the guide surface being the outer surface of at least one rotatable member which is otherwise rigidly stationarily mounted, the outer surface of the rotatable member making rolling contact with the blade as the blade moves along the abrasive surfaces, and maintaining the rotatable member in fixed relationship to the abrasive surfaces independently of the dimensions of the blade.

27. A method of sharpening an elongated edge of an object comprising providing a sharpener having two non-movably rigidly mounted members in the exposed sharpening section of the sharpener with each member being in the form of a planar comb-like structure having an elongated base portion and a plurality of coplanar integral teeth spaced by slots with the teeth of each member interdigitating with corresponding slots of the other member to form an angle therebetween, at least one member having an abrasive coated surface on at least its teeth with the teeth of both members forming an angle by the crossing teeth which results in an elongated interrupted sharpening surface on at least one side of the bisection line of the angle, moving the edge through the sharpening section against the elongated interrupted sharpening surface, and subjecting the edge to repeated alternating contact with abrasive surfaces and open slots during the movement of the edge through the sharpening section.

28. The method of claim 27 including mounting the base portions uppermost in the sharpening section with the member having abrasive coated teeth also having an abrasive coated surface on its base portion, and contacting portions of the object with the abrasive coated base portion.

29. The method of claim 28 including disposing the object against the outer surface of a rotatable guide member which is otherwise rigidly stationarily mounted and is located solely on one side of the bisection line of the angle, and maintaining rolling contact of the outer surface of the guide member with the object while the object moves through the sharpening section.

30. The method of claim 28 wherein each of the members has an abrasive coated surface on its teeth and base portion, and contacting portions of the object with the abrasive coated surfaces on the teeth and base portions of both members.

31. The method of claim 27 wherein each of the members has an abrasive coated surface on its teeth, and contacting portions of the object with the abrasive coated surfaces of the teeth of both members.

32. The method of claim 31 wherein the object is a knife blade, and contacting the abrasive surfaces with both facets which form the edge.

33. The method of claim 27 including disposing the object against the outer surface of a rotatable guide member which is otherwise rigidly stationarily mounted and is located solely on one side of the bisection line of the angle, and maintaining rolling contact of the outer surface of the guide member with the object while the edge moves through the sharpening section in contact with the sharpening surface.

* * * * *